US006722053B2

(12) United States Patent
Henry et al.

(10) Patent No.: US 6,722,053 B2
(45) Date of Patent: Apr. 20, 2004

(54) PROCESS FOR PRE-DRYING TEXTILE FILAMENTS AFTER WET TREATMENT AND DEVICE FOR PRACTICING THIS METHOD

(75) Inventors: Pierre Henry, Pfastatt (FR); Didier Thibault, Bru (FR)

(73) Assignee: Superba (Societe Anonyme), Mulhouse (FR)

( * ) Notice: Subject to any disclaimer, the term of this patent is extended or adjusted under 35 U.S.C. 154(b) by 81 days.

(21) Appl. No.: 10/193,298

(22) Filed: Jul. 12, 2002

(65) Prior Publication Data

US 2002/0182792 A1 Dec. 5, 2002

Related U.S. Application Data

(62) Division of application No. 09/559,484, filed on Apr. 27, 2000.

(60) Provisional application No. 60/132,809, filed on May 6, 1999.

(30) Foreign Application Priority Data

Apr. 30, 1999 (FR) ..... 99 05672

(51) Int. Cl.[7] ..... F26B 19/00

(52) U.S. Cl. ..... 34/69; 34/70; 34/629; 34/631; 34/635; 34/659

(58) Field of Search ..... 34/623, 629, 631, 34/634, 635, 659, 452, 461, 207, 242, 69, 70; 8/151; 162/297

(56) References Cited

U.S. PATENT DOCUMENTS

| | | | | |
|---|---|---|---|---|
| 2,572,172 | A | | 10/1951 | McCusker |
| 2,838,420 | A | | 6/1958 | Valente |
| 3,284,285 | A | | 11/1966 | Holden |
| 3,447,247 | A | | 6/1969 | Daane |
| 3,592,585 | A | | 7/1971 | Candor et al. |
| 3,730,679 | A | | 5/1973 | Schuierer |
| 3,913,241 | A | | 10/1975 | Chaikin et al. |
| 4,490,927 | A | | 1/1985 | Kissell |
| 6,473,998 | B1 | * | 11/2002 | Henry et al. ..... 34/629 |

FOREIGN PATENT DOCUMENTS

| | | |
|---|---|---|
| EP | 0 000 111 | 12/1978 |
| FR | 81 172 | 11/1963 |
| FR | 2 219 836 | 9/1974 |
| GB | 2 235 754 | 3/1991 |

* cited by examiner

*Primary Examiner*—Jiping Lu
(74) *Attorney, Agent, or Firm*—Young & Thompson

(57) ABSTRACT

A process for pre-drying textile filaments after wet treatment and a device for practicing this process. The process consists essentially in applying simultaneously to a layer of wet filaments (3) passing by on a conveyor (4) with a permeable conveying surface, on the one hand, a mechanical squeeze-drying action and, on the other hand, a pressure difference by circulation of air through said layer (3).

18 Claims, 3 Drawing Sheets

PROCESS FOR PRE-DRYING TEXTILE FILAMENTS AFTER WET TREATMENT AND DEVICE FOR PRACTICING THIS METHOD

The present invention relates to the field of textile industry, and particularly to wet treatment of textile filaments by washing and/or dyeing of the filaments, and has for its object a process of pre-drying the textile filaments after wet treatment.

The invention also has for its object a device for practicing this process.

Textile filaments are generally subjected, before their use, particularly for weaving, to washing and/or bleaching treatments as well as dyeing. These different treatments are carried out wet and have as a result excess moisture of the order of 100 to 300% by weight, and require a subsequent drying operation.

At present, this drying operation is carried out by supplying energy in the form of heat or radiation and/or an air current causing evaporation of the excess moisture. Such drying gives rise to a very high consumption of energy and, because of this, a high cost of production.

It is also known to perform mechanical spin-drying, particularly of skeins or bobbins, by means of centrifugal devices. In such a case, a residual moisture of 50% can be obtained very rapidly with low energy expenditure. However, these spin-drying processes are not useful in the framework of a continuous treatment of filaments, which is to say when the filaments pass continuously and are disposed in layers.

Finally, there is also known a process for expelling excess moisture with an over-pressure of air. Such an expulsion permits gains comparable to those obtained by mechanical drying. However, in the case of treatment of filaments in layers, such an expulsion process is not suitable, the filaments not being supported during treatment by an air jet and being at risk of becoming entangled under the influence of said jet.

The present invention has for its object to overcome these drawbacks by providing a process and a device for pre-drying of textile filaments after wet treatment, permitting obtaining optimum expulsion from a layer of filaments and ultimate drying which will be facilitated and relatively low cost.

To this end, the pre-drying process for textile filaments after wet treatment is characterized in that it consists essentially in applying simultaneously to a layer of wet filaments passing by on a conveyor with a permeable conveying surface, on the one hand, a mechanical squeeze-drying action and, on the other hand, a pressure differential by circulation of air through said layer.

The invention also has for its object a device for practicing this process, characterized in that it is essentially constituted by a conveyor for supporting the layer of filaments, with a permeable conveying surface, by a mechanical spin-drying means that acts on the layer of filaments passing by on the support conveyor, by means for applying a differential air pressure by circulation of air through said layer and by a chamber for recovering the expelled moisture having at its upper portion the support conveyor.

The invention will be better understood from the following description, which relates to a preferred embodiment, given by way of non-limiting example, and explained with reference to the accompanying drawings, in which.

Figure 1:
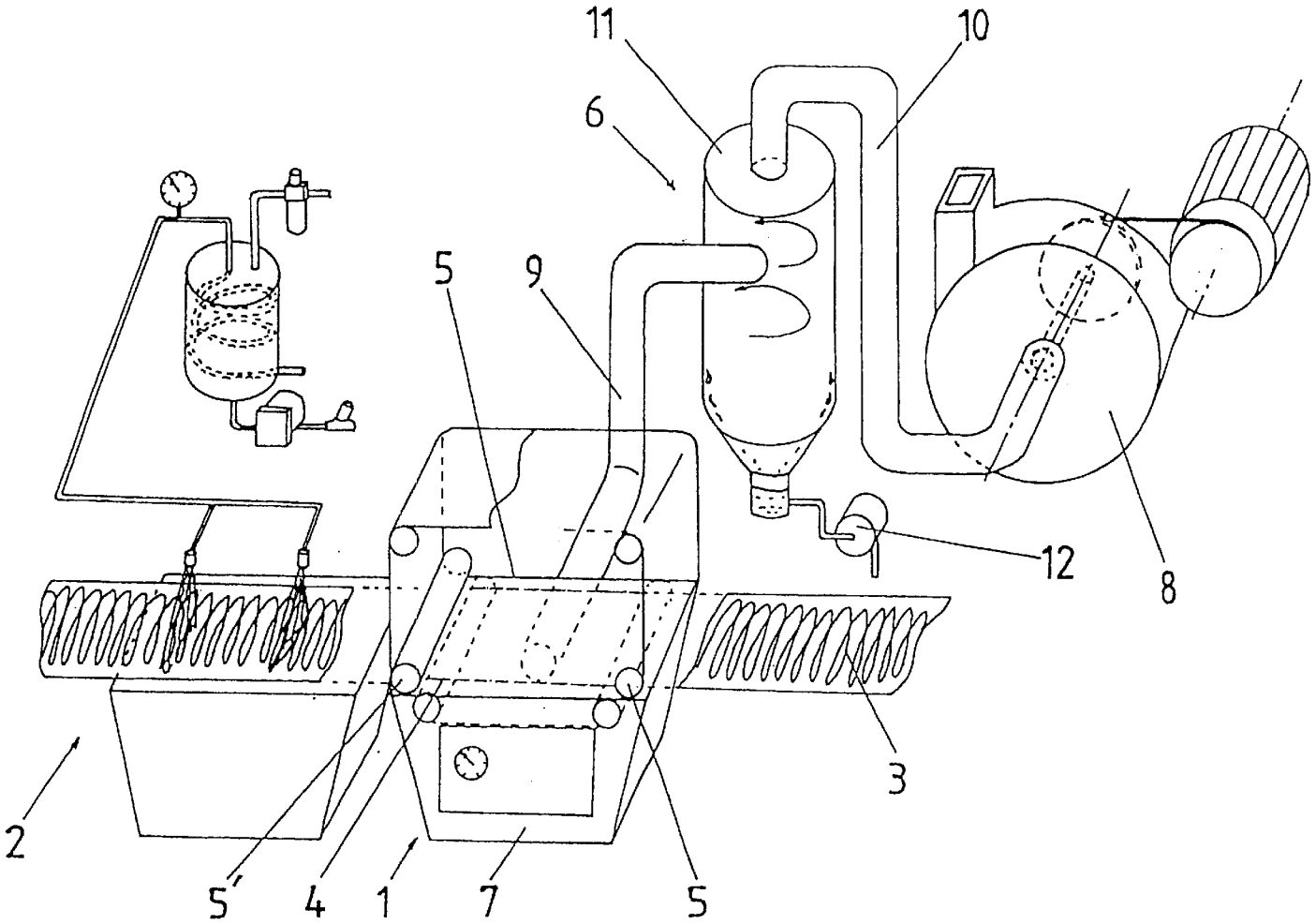
FIG. 1 is a perspective view of a device for practicing the process according to the invention, mounted in a filament treatment line.

The accompanying drawing shows a device 1 for pre-drying textile filaments after wet treatment, disposed in a filament treatment installation, downstream of a washing station 2 and upstream of a drying station, not shown. Through this device passes a layer of wet filaments 3, which require substantial expulsion of the moisture that they carry, before final drying.

To this end, according to the invention, in this pre-drying apparatus is used a process which consists essentially in applying simultaneously to the layer of wet filaments 3 passing by on the conveyor 4 with a permeable conveying surface, on the one hand, a mechanical squeeze-drying action and, on the other hand, a pressure different by circulation of air through said layer 3.

So as to improve pre-drying, the air passing through the layer of wet filaments 3 that passes by, can preferably be preliminarily heated.

According to one characteristic of the invention, the pre-drying process is carried out by means of a device 1 essentially constituted by a conveyor 4 for supporting the layer of filaments 3, with a permeable conveying surface, by mechanical squeeze-drying means 5 acting on the layer 3 of filaments that passes by on the support conveyor 4, by means 6 for applying a pressure difference by circulation of air through said layer 3, and by a chamber 7 for recovery of the expelled moisture, comprising at its upper portion the support conveyor 4.

The support conveyor 4 for the layer of filaments 3 is preferably constituted by a cloth permeable to air and water, driven by a separate motor (not shown) in synchronism with the upstream and downstream conveyors of the pre-drying device. The permeable cloth forming the conveyor 4 can, for example, be constituted by a reinforced strip of natural or synthetic rubber perforated over all its surface, or else by a strip made of a mesh of textile or metallic filaments, or by a perforated metal strip.

Figure 2:
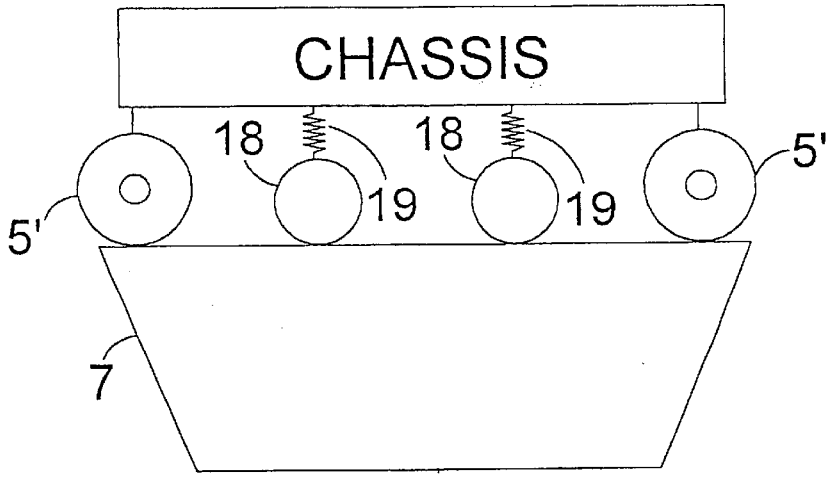
FIG. 2 is a schematic illustration of the connection of guide rollers to a chassis.

The mechanical squeeze-drying means 5 is preferably constituted by a permeable cloth guided on guide cylinders 5' and extending above the support conveyor 4 for the layer of filaments 3, the width of this cloth being greater than that of the permeable cloth forming said support conveyor 4. Preferably, the guide cylinders 5' for the cloth forming the mechanical squeeze-drying means 5 are mounted on a chassis fixed above the chamber 7 for recovery of expelled moisture as illustrated in FIG. 2. The securement of this chassis for mounting the guide cylinders 5' of the mechanical squeeze-drying means 5 on the chamber 7 for recovery of expelled moisture is preferably adjustable, such that the spacing between the support conveyor 4 and the mechanical squeeze-drying means 5 is adjustable. Thus, it is possible to carry out a more or less forceful application of the mechanical squeeze-drying means 5 onto the layer of filaments 3 passing by on the support conveyor 4.

Figure 3:
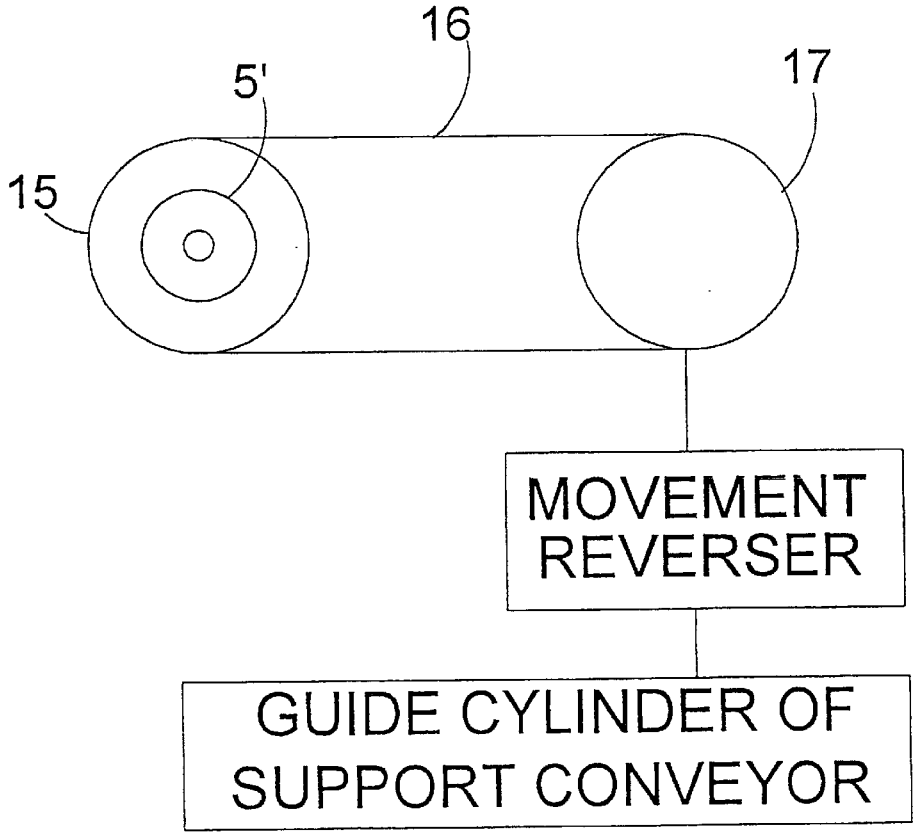
FIG. 3 is a schematic illustration of a first drive means for a guide cylinder.
Figure 4:
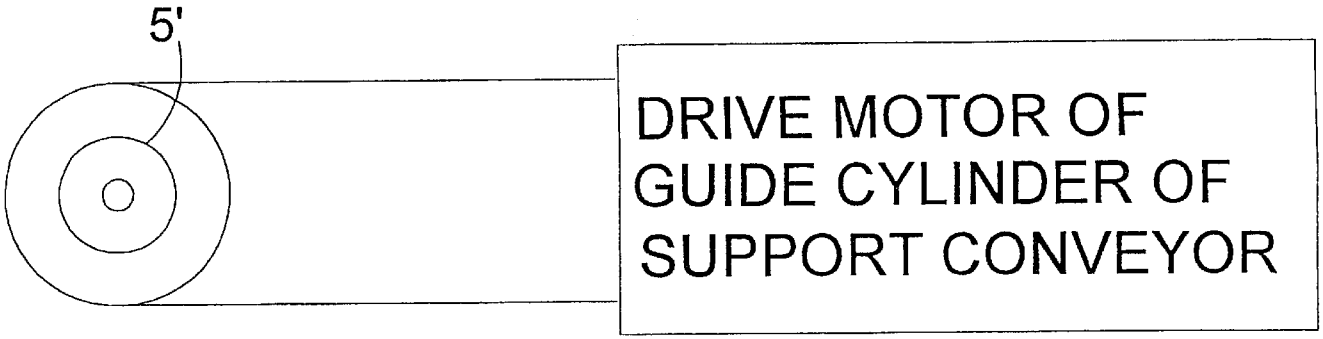
FIG. 4 is a schematic illustration of a second drive means for a guide cylinder.
Figure 5:
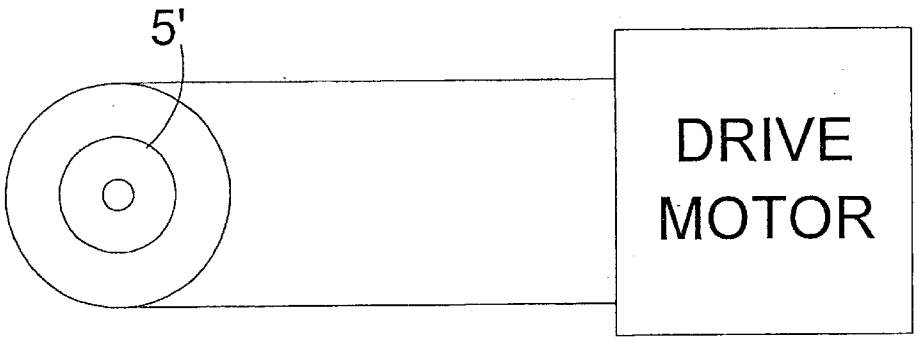
FIG. 5 is a schematic illustration of a third drive means for a guide cylinder.

Because of the application of the mechanical squeeze-drying means 5 to the layer of filaments 3 passing by on the support conveyor 4, the permeable cloth forming said squeeze-drying means 5 is automatically driven in the direction of movement of the layer of filaments while being guided on the guide cylinders 5'. However, to take account of a possible speed differential resulting from the pressure of application and friction inherent in such a pressure, it can be provided, according to another characteristic of the invention, that at least one of the guide cylinders 5' have a drive means in synchronism with the support conveyor 4. This drive means could be either a mechanical means such as a chain or toothed belt 16 coacting on the one hand with a corresponding pulley 15 secured to one of the guide cylinders 5' and, on the other hand, with a pulley 17 secured to a movement reverser connected to a guide cylinder of the permeable cloth forming the support conveyor 4 as illustrated in FIG. 3 or directly to the drive motor of this latter as illustrated in FIG. 4, or it could be a separate drive motor as illustrated in FIG. 5.

The means 6 for applying a pressure difference by circulation of air through the layer 3 of filaments passing by on the support conveyor 4 is preferably constituted by a suction device connected to the chamber 7 for recovery of expelled moisture.

This means 6 comprises, for example, an exhaust fan 8 connected to the chamber 7 by means of suction tubes 9 and 10, with the interposition of decantation means 11 provided with the pump 12 for emptying the recovered water. This means 11 is preferably constituted by a cyclone.

To improve the aspiration of moisture through the support conveyor 4 and the squeeze-drying means 5, the chamber 7 is preferably provided with peripheral sealing means (not shown) for the support conveyor 4. Thus, suction applied in the chamber 7 by the means 6 is applied totally at the level of the support conveyor 4 and gives rise to a circulation of air through said conveyor 4, the layer of filaments 3 passing on the latter and the squeeze-drying means 5 moving continuously together with the layer of filaments 3.

The moisture contained in the layer of filaments 3 is thus expelled, on the one hand, mechanically by the pressure action of the squeeze-drying means 5 on the support conveyor 4 and, on the other hand, by the effect of suction of said moisture by the air passing through said layer of filaments 3. Thus, the droplets of water that may remain by capillarity, upon mechanical expulsion, on the filaments forming the layer, are caught up by the current of air created artificially in the layer of filaments. As a result, the expulsion of the moisture is substantially improved.

According to a modified embodiment of the invention, not shown in the accompanying drawing, the means 6 for application of a pressure difference by circulation of air through the layer 3 of filaments moving along on the support conveyor 4 can also be constituted by a device for applying air pressure above the layer of filaments 3, through the squeeze-drying means 5, between the guide cylinders 5' of this latter, the mounting frame of the squeeze-drying means 5 on the chamber 7 being then provided with a cap for sealed closure coacting at its lower periphery with said chamber 7. In such a case, the space delimited by the cap surrounding the squeeze-drying means 5 is connected to a means for supplying air under pressure and the air, passing through the permeable cloth constituting said means 5, as well as the layer of filaments 3 and the support conveyor 4 which is also permeable, is evacuated into the chamber 7 entraining the moisture adhering by capillarity, the chamber 7 being then provided with a device (not shown) for pumping the expelled water. It is also possible, in the preferred embodiment described with reference to the accompanying drawing, to provide a decantation treatment of the air loaded with moisture from the chamber 7 by means of a cyclone or the like.

According to another embodiment of the invention, not shown in the accompanying drawing, it is also possible to provide the means 6 for applying a pressure difference by circulation of air through the layer 3 of filaments passing on the support conveyor 4, in the form of a device operating in a closed circuit and carrying out simultaneously on the one hand the application of suction below the support conveyor 4 and, on the other hand, the application of a pressure above the squeeze-drying means 5, this device being essentially constituted by a pump whose suction is connected to the chamber 7 and whose output empties into a cap surrounding the chassis for supporting and mounting the squeeze-drying means 5 on the chamber 7, a cyclone decantation device being moreover integrated into this closed circuit for the circulation of air between the connection of the chamber 7 and the suction of the air pump, this cyclone device being provided with a pump for evacuating the recovered water.

Such an embodiment permits optimizing the use of pressure difference as a complement to mechanical expulsion carried out by means of the squeeze-drying means 5, because the air circulation pump used acts simultaneously on the layer of filaments 3 to be pre-dried, both by pressure and by suction with continuously recycled air.

According to another characteristic of the invention, the means 6 for application of a pressure difference by circulation of air through the layer 3 of filaments passing by on the support conveyor 4 can be completed by a device for heating the air applied to said layer of filaments, not shown in the accompanying drawing, in the form of a battery of electric heaters or steam heaters, by a device for heating gas, or the like.

As a further improvement, the air passing through the moist layer of filaments 3 passing by, can also be preliminarily heated.

So as to improve the mechanical expulsion of moisture, it can also be provided to provide the squeeze-drying means 5 with pressure cylinders 18 mounted on the chassis for securing the chamber 7, between the guide cylinders 5', vertically displaceably relative to the permeable cloth constituting the squeeze-drying means 5 against the action of return springs 19, as illustrated schematically in FIG. 2. Such a provision of complementary pressure cylinders acting on the permeable cloth constituting the squeeze-drying means 5 permits increasing the mechanical pressure exerted by said squeeze-drying means 5 on the layer of filaments 3 passing by on the support conveyor 4 and to increase the mechanical drying effect, so that total expulsion of the moisture can be improved.

The pre-drying device according to the present invention is preferably mounted downstream from a washing station 2, shown schematically in the accompanying drawing, and in which the washing is preferably carried out with heated water. Such a washing permits obtaining at the output of the washing station 2 a layer of moist filaments at a relatively high temperature, such that the pre-drying operation in the device 1 according to the invention is facilitated, the hot washing water being adapted to be expelled more easily from said layer of filaments, because it adheres less to the fibers.

Thanks to the invention, it is possible to carry out a substantial expulsion of the moisture of filaments that have been subjected to a washing operation alone or after a dyeing treatment or other treatments with substantial gains in expulsion, namely of the order of 50% relative to the process used by conventional existing pre-drying devices. As a result, the consecutive operations of drying can be considerably reduced, such that the corresponding costs are also reduced to a great extent.

Moreover, because of the improvement of homogeneity of drying, the invention is also usable for the wet treatment of filaments, namely, particularly, for waterproofing, anti-UV treatment, fireproofing, dyeing, etc . . . , the washing water then being replaced by a treatment bath or by a bath of impregnation dye for the layer of filaments.

Of course, the invention is not limited to the embodiment described and shown in the accompanying drawing. Modifications remain possible, particularly as to the construction of the various elements or by substitution of technical equivalents, without thereby departing from the scope of protection of the invention.

What is claimed is:

1. Process for pre-drying textile filaments after wet treatment comprising the steps of:

applying a mechanical squeeze-drying action to a layer of wet filaments (3) passing by on a conveyor (4) with a permeable conveying surface, on the one hand, simultaneously with the mechanical squeeze-drying, applying a pressure difference by circulation of air through said layer (3), and recovering moisture expelled from the filaments, wherein the mechanical squeeze-drying is performed by a squeeze-drying means comprising:

a permeable cloth guided on guide cylinders disposed above the conveyor, wherein the permeable cloth of the squeeze-drying means is driven around the guide cylinders only by being pressed against the driven conveyor, the permeable cloth being drawn toward the driven conveyor by the applied pressure difference.

2. Process according to claim 1, characterized in that the air passing through the layer of wet filaments (3) passing by is preliminarily heated.

3. The process of claim 1, wherein the pressure cylinders are urged against the conveyor by return springs.

4. The process of claim 3, wherein a chamber for recovering expelled moisture having as its upper portion the support conveyor is arranged below the squeeze-drying means, the pressure cylinders being mounted in a frame for securing the chamber.

5. The process of claim 4, wherein the pressure cylinders are mounted in a frame for securing the chamber.

6. Device for pre-drying textile filaments after wet treatment comprising:

a driven support conveyor (4) for a layer of the filaments (3), the support conveyor having a permeable conveying surface, means for mechanically squeeze-drying the layer of filaments (3) while the layer of filaments passes by on the support conveyor (4), means (6) for application of a pressure difference by a circulation of air through said layer (3), and a chamber (7) constructed and positioned so as to allow recovery of moisture expelled from the layer of filaments, the chamber comprising at its upper portion the support conveyor (4);

wherein the means for application of a pressure difference comprises a suction device connected to the chamber; and wherein the mechanical squeeze-drying means (5) comprises a permeable cloth guided on guide cylinders (5') extending above the support conveyor (4) for the layer of filaments (3), the permeable cloth of the squeeze-drying means (5) being driven around the guide cylinders only by application under pressure against the layer of filaments (3) on the driven conveyor provided by the means for application of a pressure difference.

7. Device according to claim 6, characterized in that the support conveyor (4) for the layer of filaments (3) is constituted by a cloth permeable to air and water, driven by an independent motor in synchronism with the conveyors upstream and downstream of the pre-drying device.

8. Device according to claim 7, characterized in that the permeable cloth forming the conveyor (4) is constituted by a reinforced strip of natural or synthetic rubber perforated over all its surface or else by a strip made of a mesh of textile or metallic filaments, or by a perforated metallic strip.

9. Device according to claim 6, wherein the width of the permeable cloth of the squeeze-drying means is greater than that of the permeable cloth forming said support conveyor (4).

10. Device according to claim 9, characterized in that the guide cylinders (5') of the cloth forming the mechanical squeeze-drying means (5) are mounted on a chassis fixed above the chamber (7) for recovery of the expelled moisture.

11. Device according to claim 10, characterized in that the securement of the chassis for mounting the guide cylinders (5') of the mechanical squeeze-drying means (5) on the chamber (7) for recovery of expelled moisture is carried out in an adjustable manner, such that the spacing between the support conveyor (4) and the mechanical squeeze-drying means (5) is adjustable.

12. Device according to claim 9, characterized in that at least one of the guide cylinders (5') of the mechanical squeeze-drying means (5) is provided with a means for driving it in synchronism with the support conveyor (4).

13. Device according to claim 6, characterized in that the permeable cloth forming the squeeze-drying means (5) is automatically driven in the direction of movement of the layer of filaments and by being guided on the guide cylinders (5'), by application under pressure against the layer of filaments (3).

14. Device according to claim 6, characterized in that the chamber (7) is provided with peripheral sealing means for the support conveyor (4).

15. Device according to claim 6, characterized in that the means (6) for causing a pressure difference by circulation of air through the layer (3) of filaments passing by on the support conveyor (4) is constituted by a device for applying air pressure above the layer of filaments (3), through the squeeze-drying means (5), between the guide cylinders (5') of this latter, the frame for mounting the squeeze-drying means (5) on the chamber (7) being provided with a sealed closure cap coacting at its lower periphery with said chamber (7).

16. Device according to claim 15, characterized in that the space delimited by the cap surrounding the squeeze-drying means (5) is connected to a means for supplying air under pressure and the air, passing through the permeable cloth constituting said means (5), as well as the layer of filaments (3) and the support conveyor (4) which is also permeable, is evacuated into the chamber (7) carrying with it the moisture adhering by capillarity, said chamber (7) being provided with a pumping device for the expelled moisture.

17. Device according claim 6, characterized in that the means (6) for applying a pressure difference by air circulation through the layer (3) of filaments passing by on the support conveyor (4) is completed by a device for heating the air applied to said layer of filaments, in the form of a battery of electric or steam heaters, a gas heating device or the like.

18. The device of claim 6, wherein the means for mechanically squeeze drying comprises a single belt applied without interruption to the layer of filaments.

* * * * *